United States Patent [19]

Brannen

[11] 4,446,989

[45] May 8, 1984

[54] GASKETLESS NO-DRIP OIL CAN DISPENSER

[75] Inventor: Wyley W. Brannen, Statesboro, Ga.

[73] Assignee: Callaway Brothers, Inc., Atlanta, Ga.

[21] Appl. No.: 362,150

[22] Filed: Mar. 26, 1982

[51] Int. Cl.[3] ..... B65B 7/24

[52] U.S. Cl. ..... 222/81; 30/443; 222/108

[58] Field of Search ..... 30/443, 444, 446, 447; 222/81, 83, 108, 109

[56] References Cited

U.S. PATENT DOCUMENTS

| | | | |
|---|---|---|---|
| 2,105,575 | 1/1938 | Wiswell | 222/83 |
| 3,331,405 | 7/1967 | Gaudet | 222/81 |

FOREIGN PATENT DOCUMENTS

| | | | |
|---|---|---|---|
| 19511 | 7/1935 | Australia | 222/81 |
| 1414651 | 9/1963 | France | 222/81 |

*Primary Examiner*—E. R. Kazenske
*Assistant Examiner*—Douglas D. Watts
*Attorney, Agent, or Firm*—Laurence R. Brown

[57] ABSTRACT

A gasketless, dripless dispensing spout useful with canned oil or such liquids, is made of two pieces, namely a metallic tubular member with a cutter blade on one end and a surrounding plastic guide-reservoir tubing which is mated thereto such as by indented matching corrugations in facing surfaces. The reservoir serves by means of apertures through the spout member to receive any oil seepage on the can top and dispense it when pouring out the oil through the spout. Also it serves to channel oil about the spout back into the can by gravity flow when it is upright, thereby to avoid drip. The plastic reservoir contacts the flat surface of the can top flush in an arcuate pattern to discourage any leakage.

4 Claims, 2 Drawing Figures

GASKETLESS NO-DRIP OIL CAN DISPENSER

TECHNICAL FIELD

This invention relates to opening and pouring spouts for dispensing oil from sealed cylindrical cans, and more particularly, it relates to structure on such dispensing spouts for preventing drip.

BACKGROUND ART

It has long been a problem to prevent drip from piercing cutter-dispenser spouts for sealed cylindrical oil cans. The nature of the spouts is that a piercing blade on the spout cuts a hole and permits oil to flow thereout. The tolerances and geometry about the holes and spout have not in the past been such to confine the oil to the can and spout and thereby prevent dripping.

Thus, gaskets of various types have been proposed to seal the cutter and can top together. However, gaskets are of necessity of a nature that need be fitted by pressure to seal oil leaks. Accordingly, simplified piercing dispensers with gaskets have not operated satisfactorily. Any structure for maintaining gasket pressure makes the dispensers too expensive for general use.

Accordingly, it is an object of this invention to provide a simplified low cost gasketless piercing type cutter-dispenser for cylindrical sealed oil cans and the like that resolves the oil drip problem.

DISCLOSURE OF THE INVENTION

This invention provides a simply manufactured non-drip oil can dispenser made of two pieces. One piece is a tubular dispensing tube having a cutter blade on one end. The other piece is a surrounding friction fit plastic oil trap cylindrical jacket member with a guide lip extending therefrom to form with the cutter blade a resilient grip on the oil can wall to hold the dispenser firmly in place on the can lid.

The oil trap permits any oil that seeps out between the hole cut in the can and the cutter tube, to flow between the tubing and the jacket member which is generally cylindrical and surrounds the tubing. The jacket fits with a close collar fit to the tubing on the end opposite the cutter blade, with a spacing between the tube and jacket along its body and presenting a flat cylindrical surface in a position to abut the top of the can being opened. The guide lip extends from the flat surface along the cutter blade.

An aperture through the cutter tubing positioned inside the jacket reservoir adjacent the collar permits a flow path for any seepage of oil about the dispensing aperture made by the cutter. Such oil flows along the cutter tube and is sucked into the tubing and dispensed and thus does not accumulate on the can top about the cutter tubing.

THE PREFERRED EMBODIMENT

Figure 1:
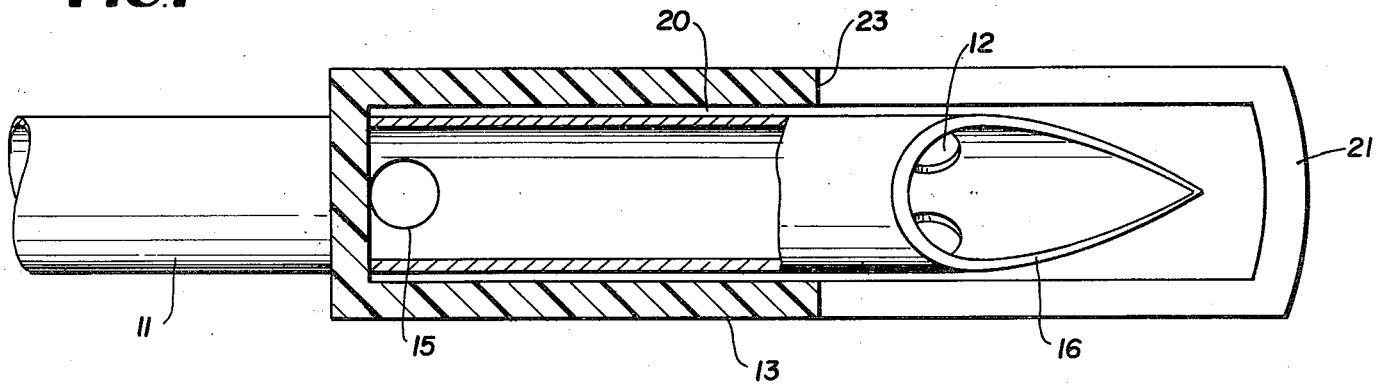
FIG. 1 is a plan view of the cutter-dispenser afforded by this invention looking down into the cutter blade, partly in section.

As seen in the drawing, the oil can opener dispenser of this invention comprises two pieces, namely a metallic cutter-dispenser tubing 11 and a plastic jacket reservoir oil trap member 13 frictionally fitting thereover.

No gaskets are required to prevent dripping and accumulation of oil on the flat closure end can top 17 adjacent an aperture cut therein by the cutter blade 16 in a conventional manner with breather holes 12 located in the cutter blade end of tubing 11.

Figure 2:
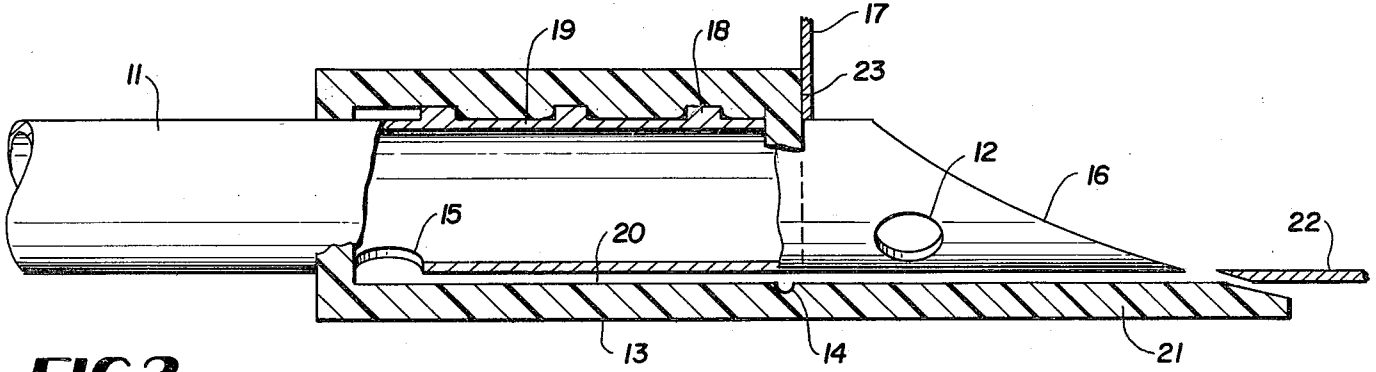
FIG. 2 is a side view of the cutter-dispenser of FIG. 1, partly in section.

The plastic reservoir jacket 13 is made of polyurethane or polyethylene or a plastic sold under such trade names as "Nylon" or "Teflon" and may be injection molded. It fits snugly over the dispenser tubing 11 and is held firmly thereon by mating detent or other surface retention structure such as dimples 18 on the spout tubing surface and mating ridges 19 on the jacket. These retention structural means are located on the top surface as shown in FIG. 2 or other location to prevent interference with the oil trap reservoir feature of the plastic jacket 13 wherein oil is retained in the spacing 20 between the jacket and the cutter tubing 11. Thus, it is seen that the jacket may be readily mounted on the tubing and registered in the proper working position by means of resiliency of the plastic.

The plastic jacket 13 is substantially cylindrical in form with an extending guide lip 21 which holds the cutter 16 adjacent the inner wall of the can side 22 and frictionally engages its outer wall.

The detent cavity 14 engages the oil can rim in sealed position with the flat cylindrical cutter end surface 23 then abutting the flat top surface of the can closure end 17 and thus serving to retain any oil that seeps out around cutter tubing 11 upon dispensing or pouring oil out of the can to flow into the spacing 20 of the reservoir jacket. The lip 21 has enough strength and resiliency to hold the dispenser-cutter assembly firmly in place after manual insertion of cutter 16 into the can lid 17 and seating of the can rim (not shown) into cavity 14.

Note that when pouring oil from the can it flows out tubing 11 and past drain hole 15, through which the oil in the oil trap reservoir 20 drains and is dispensed. This flow action provides a venturi type suction to clean out any oil and dispense it so that there is little tendency for residual oil in the oil trap reservoir 20 to leak back on top 17 of the can after emptying the oil can. Because of this action no gasket is required.

However, should a residual trace of oil be left it would drain back into the can about the tubing 11 at the cutter end because of the damming action of the cylindrical surface 23 on the can lid 17 preventing the spread.

It is accordingly evident that an improved dispenser is provided by this invention. Those features of novelty believed representative of the nature and spirit of this invention are defined with particularity in the claims.

What is claimed is:

1. A piercing cutter-dispenser for entering and forming a dispensing aperture in the flat closure end of a generally cylindrical sealed can container for liquid, such as oil, and conveying the liquid from the container, with structure for preventing leaking or dripping about the dispensing aperture, comprising in combination, a generally tubular metallic dispensing spout member having a piercing cutter blade on one end and a surface retention structure spaced along the tubular member from the cutter end adapted to retain thereon in registration a surrounding member, a plastic liquid reservoir member generally cylindrical in shape of predetermined length having a flat end surface portion with an arcuate guide lip extending therefrom in one direction along and beyond the cutter blade as an extension of the cylinder to form a container engaging cylindrical arcuate surface, and with a detent structure adapted to mate with the retention structure on the spout member, said reservoir member fitting over said spout member in mating fixed position with the spout member holding said guide lip parallel to and spaced from the cutter end to position it for forming the dispensing aperture and to support and hold the dispenser frictionally on said can in stable position after forming said dispensing aperture by resiliency between the plastic lip and cutter blade, with the cylindrical end surface portion of the plastic reservoir member adapted to fit flush against the flat closure end of the can, the reservoir construction providing between its inner cylindrical circumference and the outer circumference of the spout member a spacing forming a reservoir for receiving liquid, and having a tightened collar about the end remote from the cutter blade and the can to retain any liquid within the reservoir established between the spout member and reservoir member, the spout member near the tightened collar having an aperture therethrough adjacent said collar but inside the reservoir to pass liquid in the reservoir into the spout, whereby the plastic member engages the flat closure end of the can to retard seepage of liquid from the can out around the reservoir member and retains any oil seepage from the can out around the cutter end of the spout member within the reservoir and provides a flow path for liquid out through the spout aperture as the liquid is dispensed with said flow path providing a suction effect to withdraw any liquid adjacent the spout cutter end on the can surface, thereby producing a drip-free dispenser without gasket structure between the dispenser and the can.

2. A piercing cutter-dispenser for pouring oil from cylindrical sealed oil cans comprising in combination, a metallic tubing dispenser formed with a cutter blade at one end thereof and with retention structure at the cutter end, and a plastic jacket frictionally mating with the retention structure and forming a guide lip adjacent the cutter end for positioning the cutter blade adjacent the cylindrical inner side wall of an oil can and with the guide lip for frictionally engaging the outer cylindrical side wall of an oil can for retaining the dispenser in place on the can for pouring oil out of the tubing when the cutter cuts through the top of the oil can to thereby frictionally hold the can wall between the guide lip and cutter blade wherein the plastic jacket is substantially cylindrical in shape and includes between the tubing and the jacket spacing forming an oil reservoir, and means for disposing the jacket on the oil can in dispensing position to receive any leakage of oil about the cutter blade within said reservoir.

3. The dispenser of claim 2 wherein a drain aperture is formed by said tubing within said reservoir at a position separated from the top of the oil can at a position for draining all residual oil from said reservoir into the tubing when oil is being poured from a can.

4. The dispenser of claim 3 wherein the drain aperture is so positioned to produce a venturi suction effect on any oil in said reservoir to suck it positively into the tubing and away from the top of the can as oil is poured from a can thereby to leave the top of the can free of oil.

* * * * *